US008096277B2

(12) United States Patent
Fornara et al.

(10) Patent No.: US 8,096,277 B2
(45) Date of Patent: Jan. 17, 2012

(54) INTAKE MANIFOLD FOR AN INTERNAL COMBUSTION ENGINE PROVIDED WITH METALLIC REINFORCEMENT BRACKETS FOR FASTENING THE FUEL COMMON RAIL

(75) Inventors: Stefano Fornara, Modena (IT); Stefano Carta, Moncalieri (IT)

(73) Assignee: Magneti Marelli Powertrain S.p.A., Corbetta (IT)

( * ) Notice: Subject to any disclaimer, the term of this patent is extended or adjusted under 35 U.S.C. 154(b) by 680 days.

(21) Appl. No.: 12/238,811

(22) Filed: Sep. 26, 2008

(65) Prior Publication Data

US 2009/0133657 A1 May 28, 2009

(30) Foreign Application Priority Data

Sep. 26, 2007 (EP) ..... 07425597

(51) Int. Cl.
*F02M 35/10* (2006.01)

(52) U.S. Cl. ..... 123/184.21; 123/73 R; 123/195 R; 123/195 A; 123/456

(58) Field of Classification Search ..... 123/184.21, 123/195 A, 195 R, 456, 198 R
See application file for complete search history.

(56) References Cited

U.S. PATENT DOCUMENTS

| | | | | |
|---|---|---|---|---|
| 4,104,994 | A * | 8/1978 | Phillips | 123/73 R |
| 5,887,560 | A * | 3/1999 | Kobayashi | 123/184.21 |
| 5,970,939 | A * | 10/1999 | Motosugi et al. | 123/184.21 |
| 7,124,727 | B2 * | 10/2006 | Kogawa et al. | 123/195 R |

FOREIGN PATENT DOCUMENTS

| | | | |
|---|---|---|---|
| EP | 0385820 | A1 | 9/1990 |
| EP | 0491582 | A1 | 6/1992 |
| JP | 06-264844 | A | 9/1994 |
| JP | 07-103104 | A | 4/1995 |
| JP | 10-018938 | A | 1/1998 |
| JP | 2002-303224 | A | 10/2002 |

OTHER PUBLICATIONS

European Search Report of EP 07 42 5597 Dated Mar. 13, 2008.

* cited by examiner

*Primary Examiner* — Michael Cuff
*Assistant Examiner* — Long T Tran
(74) *Attorney, Agent, or Firm* — Venable LLP; Robert Kinberg

(57) ABSTRACT

An intake manifold for an internal combustion engine comprising an engine head in which there are obtained a number of cylinders; the intake manifold comprises a central body, wherein there are obtained an intake chamber which receives the intake air and a number of conduits each of which connects the chamber to a corresponding cylinder of the internal combustion engine; first passage through holes obtained in the central body for fastening the intake manifold to the engine head by means of first fastening screws screwed into the engine head; a common rail which receives the pressurized fuel and is connected to a number of injectors, each of which injects the fuel into a corresponding cylinder; second blank threaded fastening holes obtained in the central body for fastening the common rail to the central body itself by means of the second fastening screws screwed into the central body and, for each second fastening hole, a metallic reinforcement bracket, which presents a first assembly through hole arranged over and coaxially to a corresponding first fastening hole in order to be locked onto the central body by the corresponding first fastening screw and a second assembly through hole arranged over and coaxially to a corresponding second fastening hole in order to be locked onto the central body of the corresponding second fastening screw.

5 Claims, 3 Drawing Sheets

INTAKE MANIFOLD FOR AN INTERNAL COMBUSTION ENGINE PROVIDED WITH METALLIC REINFORCEMENT BRACKETS FOR FASTENING THE FUEL COMMON RAIL

CROSS-REFERENCE TO RELATED APPLICATION

This application claims the priority of European Patent Application No: 07425597.7, filed on Sep. 26, 2007, the subject matter of which is incorporated herein by reference.

TECHNICAL FIELD

The present invention relates to an intake manifold for an internal combustion engine provided with metallic reinforcement brackets for fastening the fuel common rail.

BACKGROUND ART

In current spontaneous ignition internal combustion engines (i.e. operating according to the "Diesel" cycle and fed with oil fuel or the like), a low-pressure pump feeds the fuel from a tank to a high-pressure pump, which in turn feeds the fuel to a common rail. The common rail is adapted to contain the pressurized fuel for feeding the fuel itself to the injectors (one for each cylinder of the engine), which are cyclically driven to inject part of the pressurized fuel present in the common rail into the corresponding cylinders. For the correct operation of the combustion, it is important for the fuel pressure value within the common rail to be constantly maintained equal to a desired value, which is generally variable as a function of the engine point and in modern engines is very high (even higher than 2000 bars). In order to work at such high pressure values, in this type of internal combustion engine, the common rails are very heavy components formed by forged steel.

In current systems, the common rail is directly fastened either to the crankcase or to the engine head, i.e. at the metallic parts of the engine by means of fastening screws; alternatively, the common rail may be fastened directly to the intake manifold formed by aluminium by means of the fastening screws. If the intake manifold is formed by thermoplastic material, the common rail must necessarily be fastened either to the crankcase or to the engine head because the intake manifold is not sufficiently rigid to support the common rail and withstand the vibrations which are caused by the engine and by the tensions which are induced by the delivery pipes which connect the common rail to the injectors and by the feeding tubes which connect the common rail to the high pressure pump.

However, fastening the common rail either to the crankcase or to the engine head has some drawbacks, as it forces to use longer and more complexly shaped delivery pipes which connect the common rail to the injectors with a consequent increase of manufacturing costs, assembly costs and load losses.

DISCLOSURE OF INVENTION

It is the object of the present invention to provide an intake manifold for an internal combustion engine provided with metallic reinforcement brackets for fastening the fuel common rail, such a manifold being free from the above-described drawbacks and specifically being easy and cost-effective to implement and allowing to obtain a strong fastening with reduced interventions and modifications to the fixtures, such as for example the mould for the intake manifold.

According to the present invention, there is provided an intake manifold for an internal combustion engine provided with metallic reinforcement brackets for fastening the fuel common rail as claimed in the attached claims.

BRIEF DESCRIPTION OF THE DRAWINGS

The present invention will now be described with reference to the accompanying drawings, which illustrate a non-limitative embodiment thereof, in which.

PREFERRED EMBODIMENTS OF THE INVENTION

Figure 1:
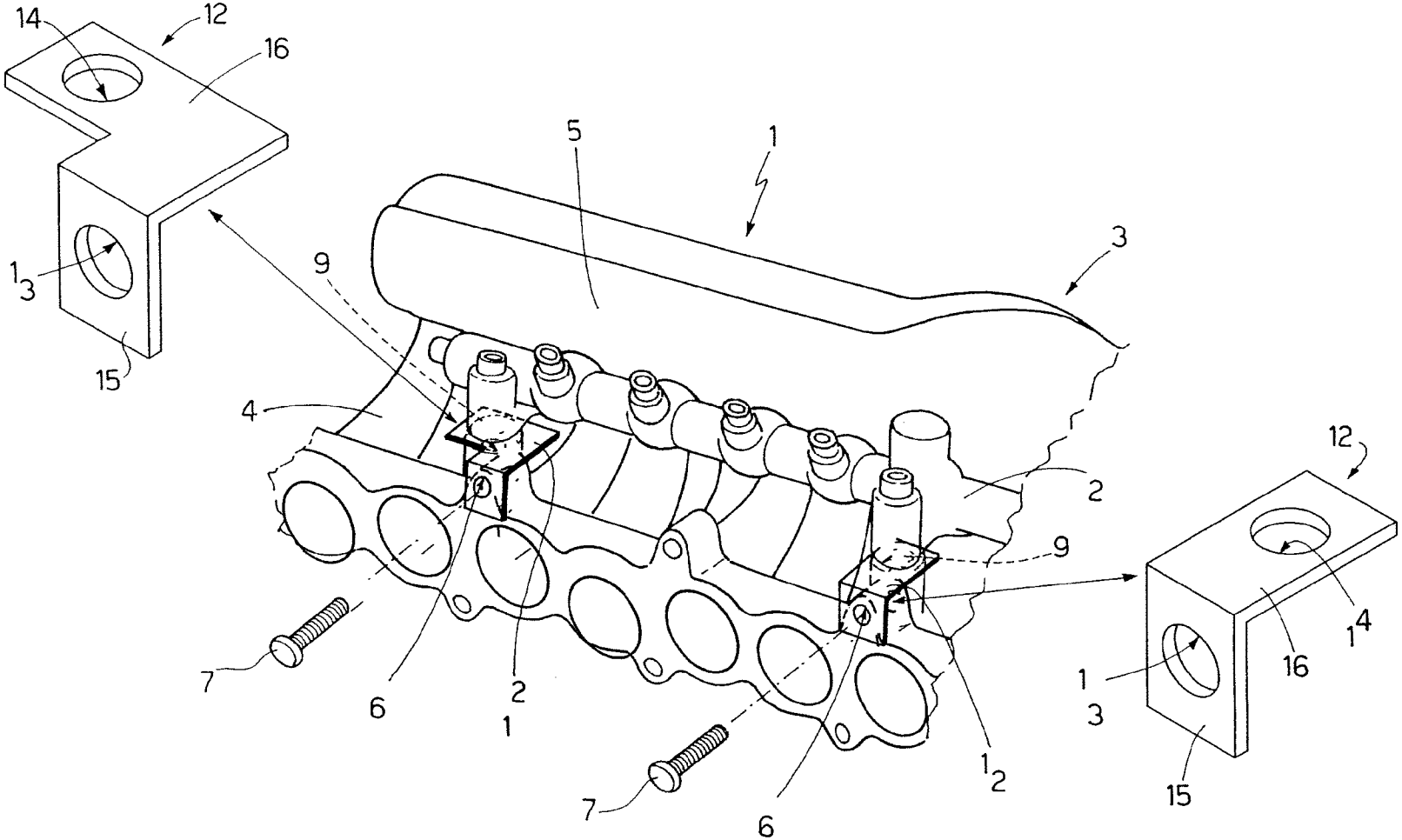
FIG. 1 is a diagrammatic view of an intake manifold for an internal combustion engine provided with metallic reinforcement brackets for supporting the fuel common rail according to the present invention.

In FIG. 1, numeral 1 indicates as a whole an internal combustion engine which comprises an engine head in which a number of cylinders (not shown) are obtained and a common rail 2 which receives the pressurized fuel and is connected to a number of injectors (not shown), each of which injects the fuel into a corresponding cylinder.

The internal combustion engine 1 further comprises a common intake manifold 3, which comprises in turn a central body 4 and conduits. In the central body 4, there is obtained an intake chamber 5 which receives the intake air, while each conduit is adapted to connect the intake chamber 5 to a corresponding cylinder of the internal combustion engine 1.

The intake manifold 3 comprises first passage through holes 6, which are obtained in the central body 4 of the intake manifold 3 to allow the fastening of the intake manifold 3 itself to the engine head by means of the first fastening screws 7 which are screwed into the engine head. In each first assembly hole 13, there is inserted a corresponding metallic bushing 8.

Figure 3:
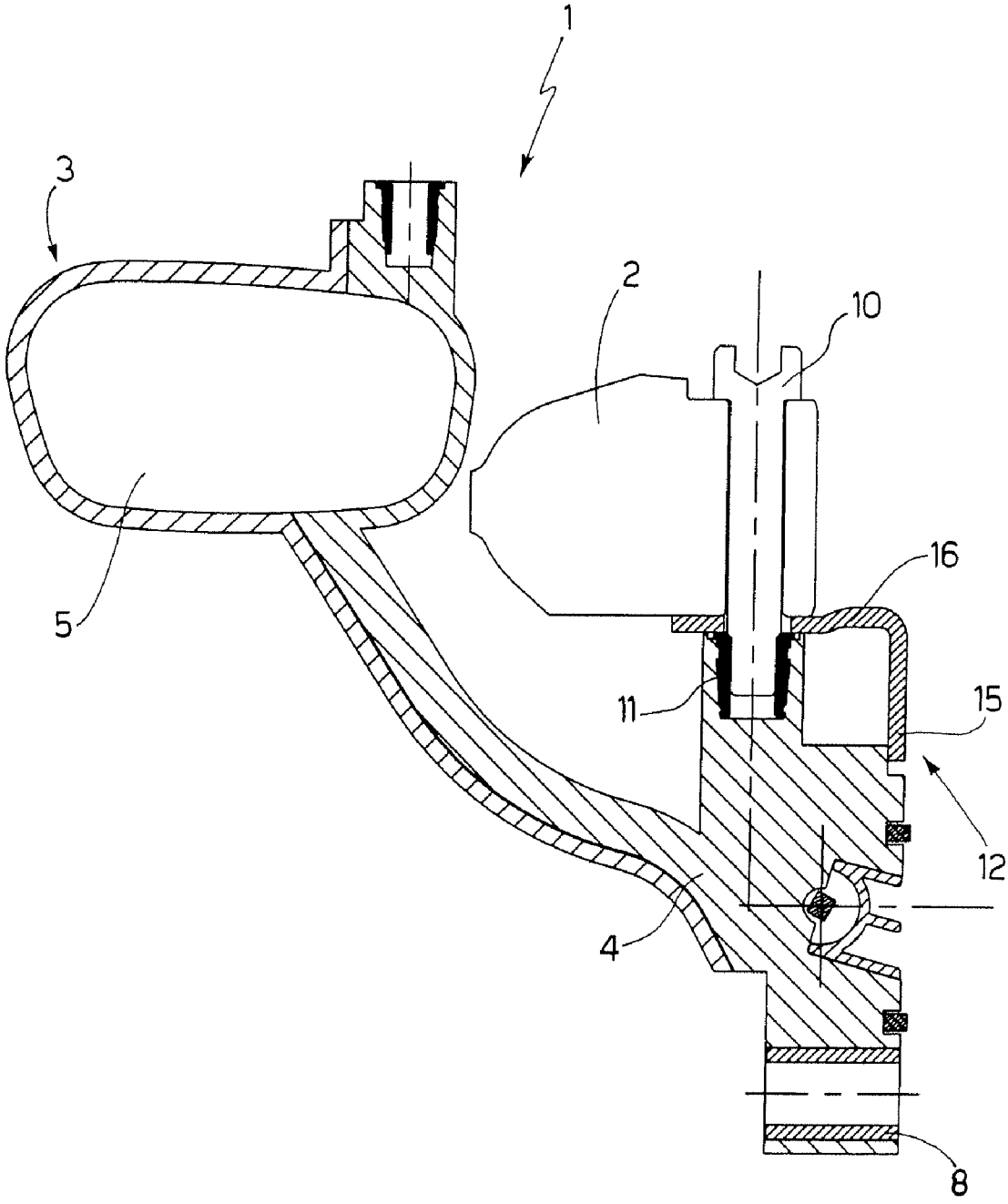
FIG. 3 is a diagrammatic side elevation section view of an intake manifold for an internal combustion engine provided with metallic reinforcement brackets in FIG. 1.

As shown in FIG. 3, the intake manifold 3 further comprises second blank, threaded fastening holes 9, which are obtained in the central body 4 of the intake manifold 3 to allow the fastening of the common rail 2 to the central body 4 itself by means of second fastening screws 10 which are screwed onto the central body 4. In each assembly hole 14 there is embedded a corresponding threaded metallic boss 11 which is co-pressed along with the central body 4.

Figure 2:
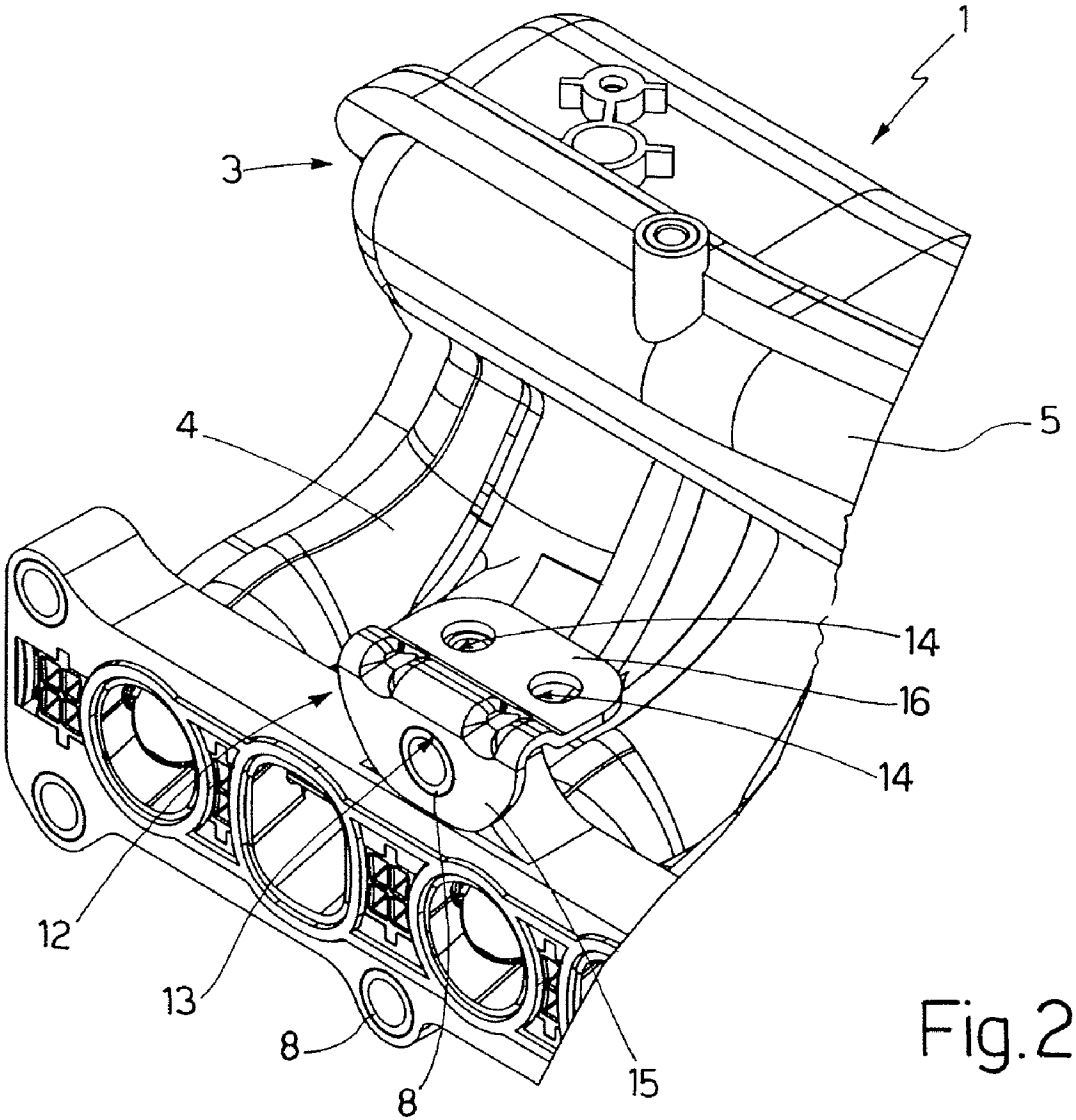
FIG. 2 shows a diagrammatic view of a different embodiment of the intake manifold for an internal combustion engine provided with metallic reinforcement brackets.

As shown in FIGS. 1 and 3, the intake manifold 3 comprises a metallic reinforcement bracket 12 for each second fastening hole 9. The metallic reinforcement bracket 12 presents a first through assembly hole 13 arranged over and coaxially to a corresponding first fastening hole 6 in order to be locked onto the central body 4 by the corresponding first fastening screw 7 and a second assembly through hole 14 arranged over and coaxially to a corresponding second fastening hole 9 in order to be locked onto the central body 4 by the corresponding second fastening screw 10. As shown in FIG. 2, a second embodiment contemplates that the metallic reinforcement bracket 12 comprises a first assembly through hole 13 arranged over and coaxially to a corresponding first fastening hole 6 in order to be locked onto the central body 4 by the corresponding first fastening screw 7 and two second assembly through holes 14 arranged over and coaxially to corresponding fastening holes 9 in order to be locked onto the central body 4 by two corresponding second fastening screws 10.

As shown in FIG. 3, each metallic reinforcement bracket 12 is "L"-shaped and thus comprises a first part 15 which presents the first assembly hole 13 and a second part 16 which presents the second assembly hole 14 which are reciprocally perpendicular.

The above-described intake manifold 3 for an internal combustion engine 1 has many advantages because it is simple and cost-effective and above all allows to obtain a solid, robust structure. Furthermore, the structure which is obtained is very compact as it allows to reduce the distance between the fuel common rail 2 and the engine head by using shorter, simpler shaped delivery pipes which connect the common rail 2 to the injectors with low manufacturing and assembly costs and with low load loss.

The invention claimed is:

1. An intake manifold for an internal combustion engine comprising an engine head having a number of cylinders; the intake manifold comprising:

a central body including an intake chamber which receives intake air and a number of pipes each of which connects the chamber to a corresponding cylinder of the internal combustion engine;

first fastening holes in the central body for fastening the intake manifold to the engine head by first fastening screws screwed into the engine head;

a common rail which receives pressurized fuel and is connected to a number of injectors, each of which injects the fuel into a corresponding cylinder;

second threaded fastening holes in the central body for fastening the common rail to the central body by second fastening screws screwed into the central body; and a first metallic reinforcement bracket presenting a first assembly through hole arranged over and coaxially to a corresponding one of the first fastening holes to be locked onto the central body by one of the first fastening screws and presenting a second assembly through hole arranged over and coaxially to a corresponding one of the second fastening hole to be locked onto the central body by one of the second fastening screws.

2. An intake manifold according to claim 1, wherein each metallic reinforcement bracket is "L"-shaped and comprises a first part which presents the first assembly hole and a second part which presents the second assembly hole and is perpendicular to the first part.

3. An intake manifold according to claim 1, wherein a corresponding metallic bushing is inserted in each first assembly hole.

4. An intake manifold according to claim 1, wherein a corresponding threaded metallic boss is embedded in each second assembly hole.

5. An intake manifold according to claim 4, wherein each threaded metallic boss is co-pressed along with the central body.

* * * * *